United States Patent [19]

Shavyrin et al.

[11] 3,957,663

[45] May 18, 1976

[54] LUBRICANT COMPOSITION FOR DRILLING PIPE

[76] Inventors: Vladimir Sergeevich Shavyrin, ploschad Svobody, 4, kv. 18; Vyacheslav Nikolaevich Gusakov, Ul. Kuibysheva, 23, kv. 3, both of Gorky; Klavdia Vasilievna Pankova, Ul. Tsiolkovskogo, 1a, kv. 50, Volgograd; Nina Petrovna Polyakova, Ploschad Svobody, 4, kv. 116; Natalya Petrovna Shirkaeva, Ul. Svetloyarskaya, 75, kv. 5, both of Gorky; Valentin Nicolaevich Gorin, Ul. Basseinaya, 53, kv. 1; Oleg Semenovich Golovin, Ul. Mikhailova, 8, kv. 29, both of Leningrad, all of U.S.S.R.; Alexei Egorovich Mastjukov, deceased, late of Gorky, U.S.S.R.; Maria Pavlovna Mastjukova, heir, ploschad Svobody, 4, kv. 67, Gorky, U.S.S.R.

[22] Filed: May 23, 1974

[21] Appl. No.: 472,865

Related U.S. Application Data

[63] Continuation-in-part of Ser. No. 276,041, July 28, 1972, abandoned.

[52] U.S. Cl. ..... 252/43; 106/234; 252/56 R; 252/59

[51] Int. Cl.[2] ..... C10M 3/12

[58] Field of Search ..... 252/9, 16, 43, 56 R, 252/59, 85 M; 106/230, 232, 234; 117/135; 260/28, 28.5

[56] References Cited

UNITED STATES PATENTS

| | | | |
|---|---|---|---|
| 2,245,649 | 6/1941 | Caprio | 252/16 X |
| 2,397,805 | 4/1946 | Ott | 106/232 X |
| 2,836,507 | 5/1958 | Barth | 106/232 X |

OTHER PUBLICATIONS

Kirk–Othmer, "Encyclopedia of Chemical Technology", Vol. 17 (56), pp. 475–478.

*Primary Examiner*—Delbert E. Gantz
*Assistant Examiner*—Andrew H. Metz
*Attorney, Agent, or Firm*—Holman & Stern

[57] ABSTRACT

A method of preparation of a lubricant for lubricating the external surface of a drilling pipe comprising the steps of preparing a mixture consisting essentially of gear box oil, petroleum paraffins, bitumen and distillation residue; primary heating of said mixture to 100°C and secondary heating up to 300°C.

1 Claim, No Drawings

LUBRICANT COMPOSITION FOR DRILLING PIPE

This application is a continuation-in-part of co-pending application Ser. No. 276,041, filed July 28, 1972, now abandoned.

The present invention relates to methods of preparing materials for lubrication of external surface of drilling pipes used in the process of drilling wells preferably with diamond or hard alloy drilling crowns with water being used as mud fluid.

It is known that a drilling pipe rotating at a high speed is subject to heavy vibration, which is transmitted both to the drilling crown and rig. This causes rapid wear of units and machine parts of a drilling machine and reduction of the drilling speed because of heavy friction of the drilling pipe against the walls of the well.

In addition, vibration leads to considerable increase (sometimes by a factor of 2 to 2.5) in power consumption during of rotating drilling pipes in the well.

Hence, the drilling tool vibration control is one of the basic and most important problems in the modern diamond drilling practice, the solution of which would make it possible to rotate the diamond crown at a speed from 500 up to 1500 rpm and therefore increase the drilling speed.

The use of the most effective and inexpensive means for vibration control which are materials for lubrication of drilling pipes, opens the way for wide application of diamond drilling as well as for increasing its efficiency.

Known in the art is a method of preparing a material comprising rosin, gear-box oil and bitumen for lubrication of the external surface of a drilling pipe. The mixture is heated to 100°C and kept at this temperature for 20 minutes. Then the material is considered for use as a lubricant.

The components mentioned have the following characteristics: Gear-box oil— a product of petroleum rectification with the congealing temperature −20°C as the highest, mechanical impurities not exceeding 0.05% by weight; relative viscosity as 100°C is 2.7°–3.2°C, contains traces of water and does not contain water soluble acids and alkali; flash point (in the open cup) is not below 170°C.

Bitumen—an oxidation product of petroleum distillation residue, petroleum cracking process and petroleum products with a melting point not below 90°C; solubility in chloroform and benzene not less then 99% by weight; the depth of needle penetration at 25°C is in the range 5–20 mm, expansibility at 25°C is not less then 1 cm; weight loss at 160°C during 5 hours is not more then 1%; the depth of needle penetration into residue (after testing for weight loss from initial weight) is not less then 60%; flash point is not below 230°; water soluble acids and alkali are not present; water-traces.

According to this method the components of the mixture are heated to melting temperature in order to obtain homogeneous compound. The material obtained allowed to decrease to some extent the vibration of drilling pipes in the process of drilling However, the material did not have adequate resistance against mud fluid and was easily washed off from the surface of drilling pipes.

That's why it was required to apply the material several times. This in turn led to considerable consumption of materials, spare labour and time in performing the above mentioned operation.

In addition, preparation of the material requires the use of rosin as one of the components (rosin content may be as high as 25–30% by weight). Rosin is in short supply and is an expensive material.

Attempts have been made to replace rosin with some other less scarce materials. However such materials could not provide required adhesion of the lubricating material with the surface of drilling pipes, washed by mud fluid.

Known in the art are many lubricants including lubricants for coating the building berth while launching seagoing vessels. This lubricating material contains (% by weight) greasless paraffin 50–80, rosin 5–15, asphalt 10–14, and petrolatum 10–30.

However this material has a low adhesion to metal surfaces, contains scarce and expensive rosin and a high percentage of paraffin, thus making its use inexpediant in the process of absorbing vibration of drilling pipes during drilling of wells.

When dealing with a wide scope of drilling work, an increase of productivity of drilling tools is required. However, an increase of rotation speed of the drilling pipes leads to vibration of pipes and to the friction between the pipes and well walls. This in turn reduces the life of the drilling tools and therefore makes drilling impossible at high speeds.

Some effective means for preventing vibration are unknown to those skilled in art at the present time.

The basic object of the invention is to provide a method of preparing a material for lubrication of the external surface of a drilling pipe with a ratio of components allowing the materials to sufficiently reduce vibration of the drilling pipes at the increased speed of the drilling process.

A specific object of the invention is to increase the drilling speed and to increase the life of the drilling tool, while reducing the consumption of diamonds leading in turn to increasing productivity of the drilling tools and a more effective drilling process.

Another object of the invention is to provide a material resistant to the washing-off action of the mud fluid.

Still another object of the invention is the replacement of expensive and scarce components such as rosin, used in the lubricants known to the art, for distillation residues obtained after isolation of rosin and rectification of wood terpentine and pine flotation oil which are cheaper and more easily obtainable material.

These and other objects of the invention are obtained by means of a method of preparation of a lubricant for lubricating the external surface of drilling pipes comprising the steps of preparing a mixture consisting essentially of gear-box oil 45–55% by weight, petroleum paraffins 4–6, distillation residue after the isolation of rosin and rectification of wood turpentine and pine flotation oil 30–40% by weight and optionally, bitumen; heating of said mixture to 100°C; holding said mixture at this temperature for 20 minutes while stirring; heating the mixture to 300°C; holding the mixture at this temperature for 1 hour.

The method makes it possible to use inexpensive components for preparing the material, intended for lubrication of the external surface of a drilling pipe to absorb the vibration of the pipe and to increase the speed of drilling.

The above-mentioned proportion found by the authors, makes it possible to prepare a material with acceptable resistance to the washing-off action from the surface of the pipes, and thus may be effectively used in the process of drilling.

In the process of development of the lubricant the authors found that increasing the content of bitumen in the material (the lubricant) makes it fragile and this leads to sliding of the lubricant from the drilling pipe surface.

Increased content of distillation residues leads to thinning of the material (the lubricant) and it is washed off from the surface of the drilling pipe at the high speed of rotation.

The found percentage of petroleum paraffins, having water repelling characteristics increase waterproof capacity of the material proposed by the authors.

These paraffins have a melting point not below 50°C and is crystalline by nature; they do not contain water or water soluble acids and alkali.

The replacement of scarce and expensive rosin for distillation residues makes it possible to reduce the price of proposed material without deterioration of its qualities such as washing off resistance in water and adhesion to metal surfaces. The material spread on the surface of a drilling pipe is transferred in the process of drilling to the cracks in the walls of well. In this case the friction force of drilling pipe against the walls of the well and leakage of the mud fluid through the cracks will be reduced.

In accordance with the proposed method there are two steps of heating the mixture. At the first step the compounds are melted and effectively stirred during the period of time it is held.

At the second step of the heating the mixture its desirable characteristics are stabilized during the period it is held.

The invention will be better understood from the consideration of the examples of the proposed method of preparing a material for lubrication of the external surface of a drilling pipe.

EXAMPLE 1

The reactor is loaded with gear-box oil 45%, petroleum paraffins 4%, bitumen 6%, and distillation residues obtained after isolation of the rosin and rectification of the turpentine and pine flotation oil in rosin extraction production 45% by weight. The mixture is heated to 100°C and carefully stirred during 15 minutes. Then the reaction mixture undergoes the second step of heating, when it is heated to 280°C and is held at this temperature for 1 hour. In the process of holding the mixture at this temperature a vapour-gas mixture is released. The ready lubricant is poured into a metal container at the temperature of 80°C.

EXAMPLE 2

The reactor is loaded with gear-box oil 55%, petroleum paraffins 6%, and distillation residues obtained after isolation of the rosin and rectification of wood turpentine and pine flotation oil 30% by weight and, optionally, the bitumen. At the first step the mixture is heated to 100°C and is held at this temperature for 18 minutes with careful stirring.

At the second step, the mixture is heated to 300°C and is held at this temperature for 1 hour.

In the process of holding the mixture at this temperature a vapor-gas is being released from it. Ready material is poured into metal containers at the temperature of 80°C.

EXAMPLE 3

The reactor is loaded with gear-box oil 50%, petroleum paraffins 5%, and distillation residue obtained after isolation of the rosin and rectification of the turpentine and pine flotation oil in rosin-extraction production 35% by weight and, optionally, the bitumen. The mixture is heated to 100°C and is carefully stirred during 20 minutes. Then the reaction mixture undergoes the second step of heating, when it is heated to 260°C and is held at this temperature for 1 hour. In the process of holding the mixture at this temperature a vapor-gas mixture is released. The ready lubricant is poured into a metal container at the temperature of 80°C.

The tests have shown that the material prepared in accordance with the above-mentioned method, decreases considerably the vibration of the drilling pipe; such decrease is resulted in reduction of diamond consumption to 25–30% and increase of drilling speed to 45%, stabilization of rig's work and increase in its working life.

The material prepared according to the proposed method reduces the force of friction of the drilling pipe against the walls of the well, thus reducing the input power required for the operation of the machine by 30–50%.

The wear of the drilling pipes is reduced while drilling speed of the tool is increased and, therefore, the material helps to increase the efficiency of the rig, while drilling deep wells.

It was found that material prepared according to the proposed method protects drilling pipes against corrosion and substantially prevents absorbtion of mud fluid by the cracks in walls of well.

It is claimed:

1. A lubricant composition consisting essentially of; (A) from 45 to 55 percent of a gear-box oil, which is a product of petroleum rectification with a congealing temperature of not higher than −20°C, impurities not exceeding 0.05 percent by weight, a relative viscosity at 100°C of 2.7°to 3.2°and an open cup flash of at least 170°C; (B) 4 to 6 percent of crystalline petroleum paraffins of a melting point of at least 50°C; (C) from 30 to 45 percent by weight of a distillation residue obtained after isolation of the rosin and rectification of wood turpentine and pine flotation oil; (D) from 0 to 21 percent of bitumen which has a melting point of at least 90°C; a solubility in chloroform and benzene of at least 99 percent by weight and a depth of needle penetration at 25°C in the range of from 5 to 20 mm; wherein said composition is prepared by heating components (A), (B), (C) and (D) to 100°C and holding the mixture at said temperature for 20 minutes while stirring and subsequently heating said mixture to 300°C and holding the mixture at 300°C for 1 hour.

* * * * *